US007320630B2

(12) United States Patent
Nakamura

(10) Patent No.: US 7,320,630 B2
(45) Date of Patent: Jan. 22, 2008

(54) TOP COWL FOR OUTBOARD MOTOR AND MOLD FOR FORMING TOP COWL

(75) Inventor: Daisuke Nakamura, Shizuoka-ken (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 11/320,100

(22) Filed: Dec. 28, 2005

(65) Prior Publication Data

US 2006/0137646 A1 Jun. 29, 2006

(30) Foreign Application Priority Data

Dec. 28, 2004 (JP) ..... 2004-378525

(51) Int. Cl.
*B63H 20/32* (2006.01)

(52) U.S. Cl. ..... 440/77

(58) Field of Classification Search ..... 440/77
See application file for complete search history.

(56) References Cited

U.S. PATENT DOCUMENTS 3,358,668 A * 12/1967 Post et al. ..... 123/198 E
4,600,396 A * 7/1986 Crane et al. ..... 440/77
5,302,147 A * 4/1994 Oishi ..... 440/77
5,391,099 A * 2/1995 Allain ..... 440/77
2004/0014379 A1* 1/2004 Yasuda et al. ..... 440/77

FOREIGN PATENT DOCUMENTS

JP 2002-349257 12/2002
JP 2004-299485 10/2004

* cited by examiner

*Primary Examiner*—Stephen Avila
(74) *Attorney, Agent, or Firm*—Knobbe, Martens, Olson & Bear, LLP

(57) ABSTRACT

An outboard motor has a top cowl and a bottom cowl. A elongate thickened portion protrudes inwardly from an inner surface of the top cowl into an engine compartment. A bottom opening edge of the top cowl mates with the bottom cowl. The elongate thickened portion extends along the length of top cowl from the forward end of the opening edge to a rearward end of the opening edge. A mold for forming the top cowl has an entrance sprue that is located in a position corresponding to the position of one end of an opening edge of the top cowl. An exit sprue of the mold is located in a position corresponding to the position of an opposing end of the opening edge of the top cowl. The mold defines a top cavity and side cavities that are used to mold the top cowl.

22 Claims, 7 Drawing Sheets

TOP COWL FOR OUTBOARD MOTOR AND MOLD FOR FORMING TOP COWL

PRIORITY INFORMATION

The present application is based on and claims priority under 35 U.S.C. § 119(a-d) to Japanese Patent Application No. 2004-378525, filed on Dec. 28, 2004, the entire contents of which is expressly incorporated by reference herein.

BACKGROUND OF THE INVENTION

1. Field of the Invention

The present invention generally relates to top cowls for outboard motors and more particularly relates to top cowls that cover engines of outboard motors and molds for forming such top cowls.

2. Description of the Related Art

Outboard motors can be used to propel watercraft. Outboard motors often have an engine disposed within a protective cowling. The protective cowling typically includes a top cowl and a bottom cowl. Air flows through the cowling to the engine. Air inlet openings at the rear of the cowling can provide fluid communication between the engine and ambient air outside of the cowling. The air inlet openings are typically positioned rearwardly because spray splashed up from waves normally does not flow through these air inlet openings when the watercraft moves in the forward direction.

Japanese Patent Publication No. 2002-349257 discloses that top and bottom cowls are coupled with each other by utilizing bottom side hooks and top side hooks. The bottom side hooks are coupled to an opening edge of the bottom cowl. The top side hooks are coupled to an opening edge of the top cowl. These top side hooks and bottom side hooks can releasably couple the top cowl to the bottom cowl.

The top cowl can be made of a nonferrous metal. Japanese Patent Publication No. 2004-299485, for example, discloses a top cowl that is made of a nonferrous metal. Top cowls are often made of reinforced resin. Unfortunately, these top cowls are heavy and non-recyclable. The top cowls made of resin are typically formed by injection molding or sheet molding. To sheet mold a top cowl, a glass-fiber-reinforced thermosetting resin sheet is placed onto a surface of a mold. For a multi-layer top cowl, several sheets can be placed onto the surface of the mold. The resin sheets are then heated while pressure is applied to form a molded article having a uniform thickness. Unfortunately, these top cowls need to have a relatively large minimum thickness to ensure the top cowl is sufficiently rigid to protect the engine. This minimum thickness can result in a relatively heavy top cowl.

Nonferrous metals, such as aluminum, have been used to make top cowls. These top cowls are often formed by a die-casting process. Unfortunately, marks from a sprue or overflow that remains on the exposed surface of a casting article may require additional manufacturing procedures to produce an article having a suitable appearance. This significantly limits the layout of the sprue and overflow to particular locations, thus limiting design flexibility. These design constraints can also lead to excessively thick portions of the cowl that undesirably increase the overall weight of the cowl.

SUMMARY OF THE INVENTION

An aspect of the present invention disclosed herein includes the realization that a top cowl for an outboard motor can be rigid and lightweight cowling while having a desirable appearance. The top cowl can have one or more reinforcement ribs that enhance the mechanical properties of the top cowl. These ribs can also aid in the casting process so as to reduce marks from a sprue and/or overflow, thus improving the overall appearance of the top cowl.

In some aspects of the present invention, an outboard motor has a cowling comprising a bottom cowl and a top cowl configured to couple to the bottom cowl. The top cowl comprises a top cowl body that surrounds at least a portion of an engine of the outboard motor. The top cowl is configured to couple with the bottom cowl, and the top cowl comprises an elongate thickened portion that extends along the top cowl body in a fore to aft direction between a front end and a rear end of the top cowl body.

In some aspects, an outboard motor has a top cowl and a bottom cowl. A rib protrudes inwardly from an inner surface of a top cowl into an engine compartment. A bottom opening edge of the top cowl mates with the bottom cowl. The rib extends along the length of top cowl from the forward end of the opening edge to a rearward end of the opening edge. A mold for forming the top cowl has an entrance sprue that is located in a position corresponding to the position of one end of an opening edge of the top cowl. An exit sprue of the mold is located in a position corresponding to the position of an opposing end of the opening edge of the top cowl. A top cavity of the mold allows part of molten metal to flow from the entrance sprue to the exit sprue through a top cavity. Side cavities allow the remaining molten metal to flow from the entrance sprue to the exit sprue through the side cavities, in which the part of molten metal that flows through the top cavity faster than the flows of the remaining molten metal passing through the side cavities.

In some aspects of the present invention, a top cowl of an outboard motor is made of a nonferrous metal. The top cowl can include a thickened portion that extends in the fore to aft direction. The thickened portion can be an elongate rib that extends along the length of the top cowl preferably extending along the inner surface of the top cowl. The inner surface can define at least a portion of an engine compartment that accommodates an internal combustion engine. The thickened portion preferably protrudes downwardly from the inner surface towards the engine. The top cowl has a bottom edge that mates with an upper edge of a bottom cowl. The top cowl and bottom cowl cooperate to define the engine compartment. In some variations, the thickened portion extends along the top cowl from a forward end to a rearward end of the bottom edge.

In other aspects of the present invention, a mold can be used to form a top cowl. The mold includes an entrance sprue for injecting material into a mold cavity of the mold. The entrance sprue is located in a position generally corresponding to the position of one end of an opening edge of the top cowl. An exit sprue is located in a position generally corresponding to the position of the other end of the opening edge of the top cowl. The mold cavity includes a top cavity and opposing side cavities. The top cavity can allow at least a portion of molten material (e.g., molten metal) to flow from the entrance sprue to the exit sprue through the top cavity. The side cavities can allow the remaining molten material to flow from the entrance sprue to the exit sprue. The flow rate through the top cavity can be greater than the flow rate through the side cavities. As such, molten material flows through the top cavity faster than the molten material passing through the side cavities. Even though the length of the top cavity is greater than the length of the side cavities, the molten material that exits the entrance sprue can be divided into separate flows that pass through the top cavity and side cavities, such that these flows can reach the exit sprue at approximately the same time.

In other aspects of the present invention, a mold for forming a top cowl of nonferrous metal for an outboard motor is provided. The mold comprises a first mold portion and second mold portion that define a mold cavity shaped to form a top cowl having a top portion and side wall portions that depend from the top portion and define a bottom edge of the top cowl. An entrance sprue is disposed at a front end of the mold cavity. An exit sprue is disposed at a rear end of the mold cavity. A top cavity of the mold cavity is configured to accommodate flow of molten metal from the entrance sprue to the exit sprue so as to form the top portion of the top cowl. The mold also has side cavities configured to accommodate flow of molten metal from the entrance sprue to the exit sprue so as to form the side wall portions of the top cowl. A bottom edge of the mold cavity corresponds to the bottom edge of the top cowl, wherein the entrance and exit sprues are positioned at or adjacent the bottom edge of the mold cavity, and the top cavity and side cavities are configured so that molten metal flows faster through the top cavity than through the side cavities.

BRIEF DESCRIPTION OF THE DRAWINGS

The above-mentioned and other features of the invention disclosed herein are described below with reference to the drawings of preferred embodiments. The illustrated embodiments are intended to illustrate, but not to limit the invention. The drawings comprise eight figures.

DETAILED DESCRIPTION OF THE PREFERRED EMBODIMENT

Figure 1:
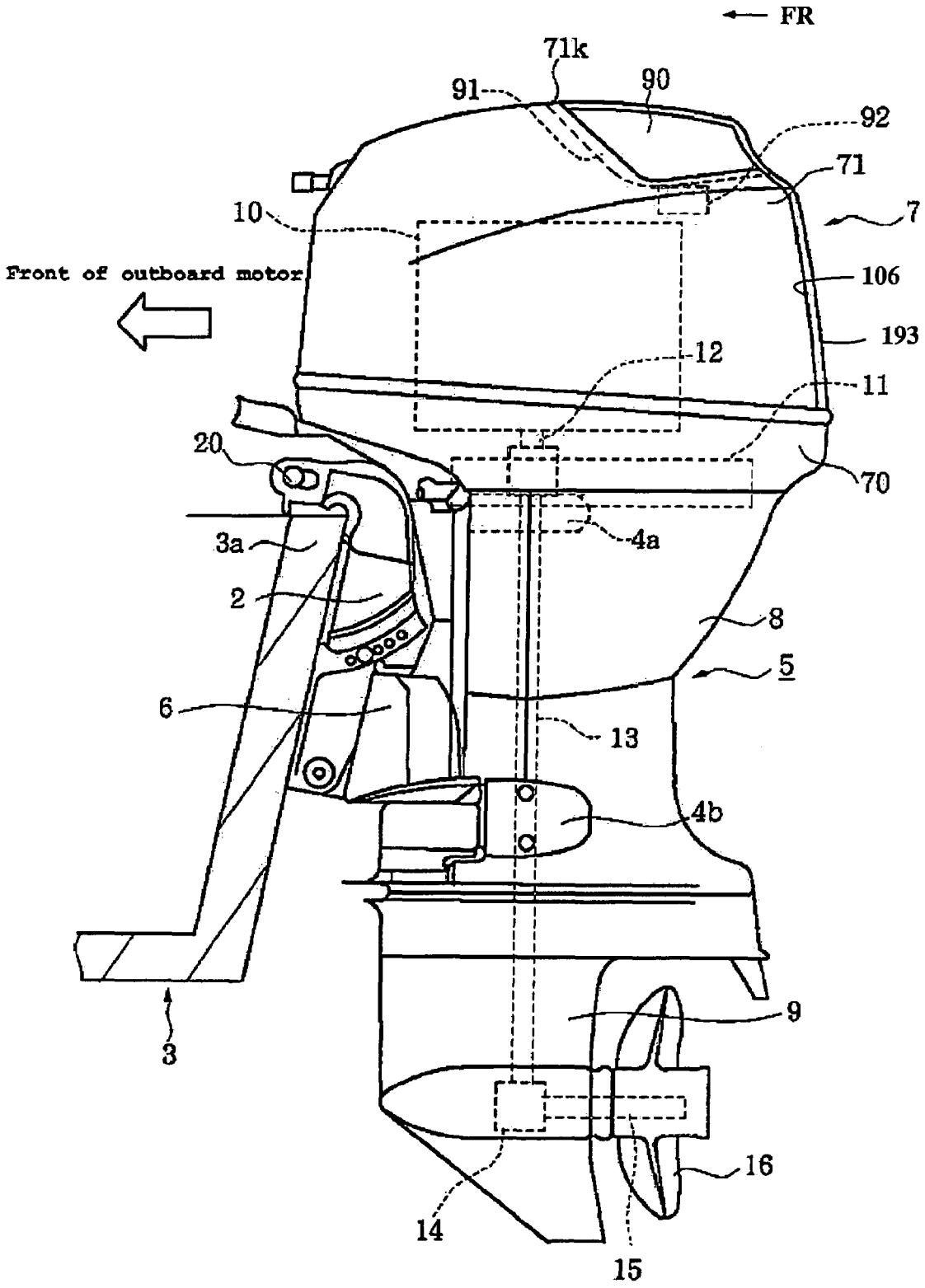
FIG. 1 is a side view of a watercraft having an outboard motor in accordance with a preferred embodiment of the present invention. An associated watercraft, on which the outboard motor is mounted, is partially shown in section. Several of the internal components of the outboard motor are illustrated in phantom.
Figure 2:
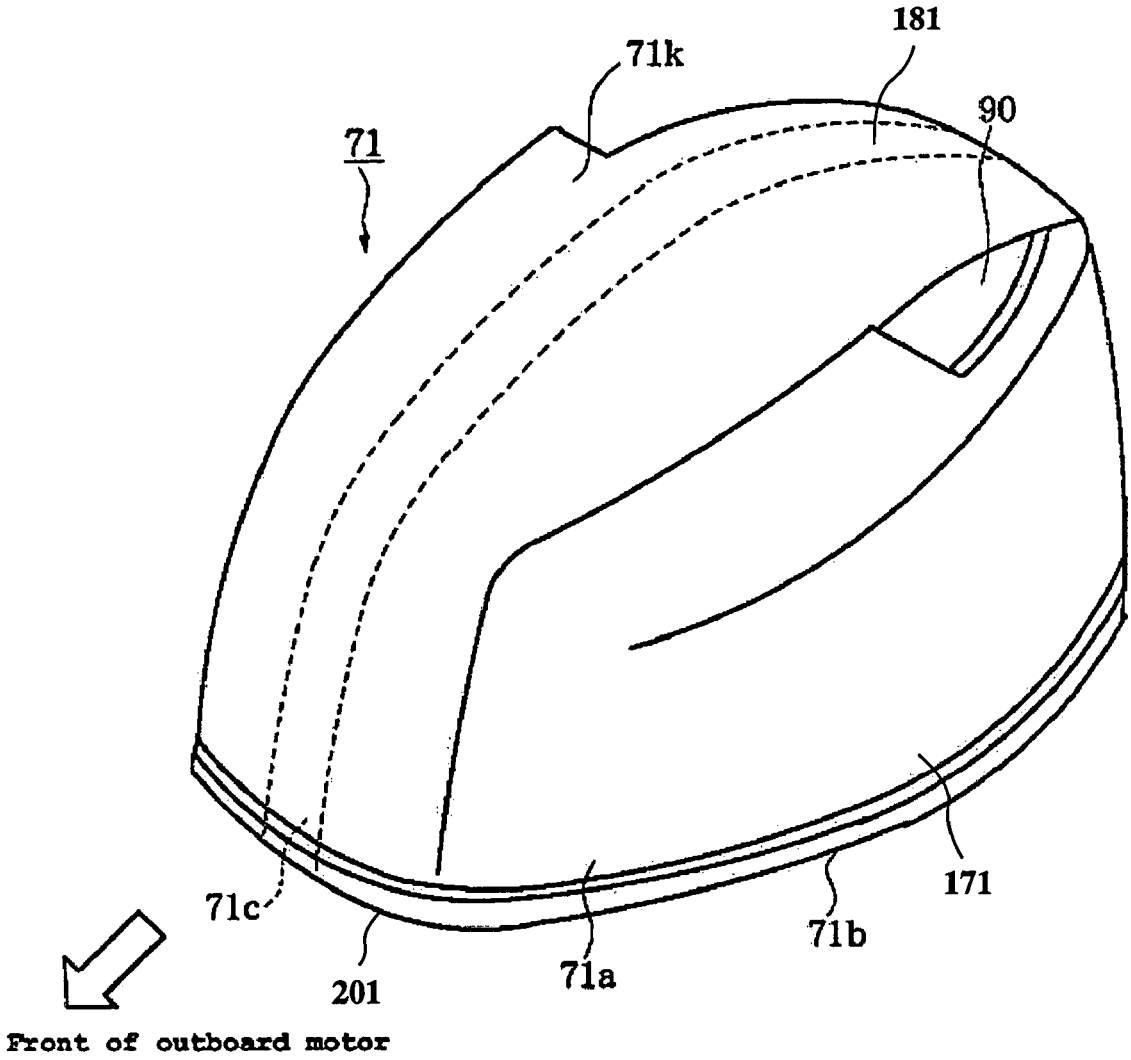
FIG. 2 is a perspective view of a top cowl of the outboard of FIG. 1.
Figure 3:
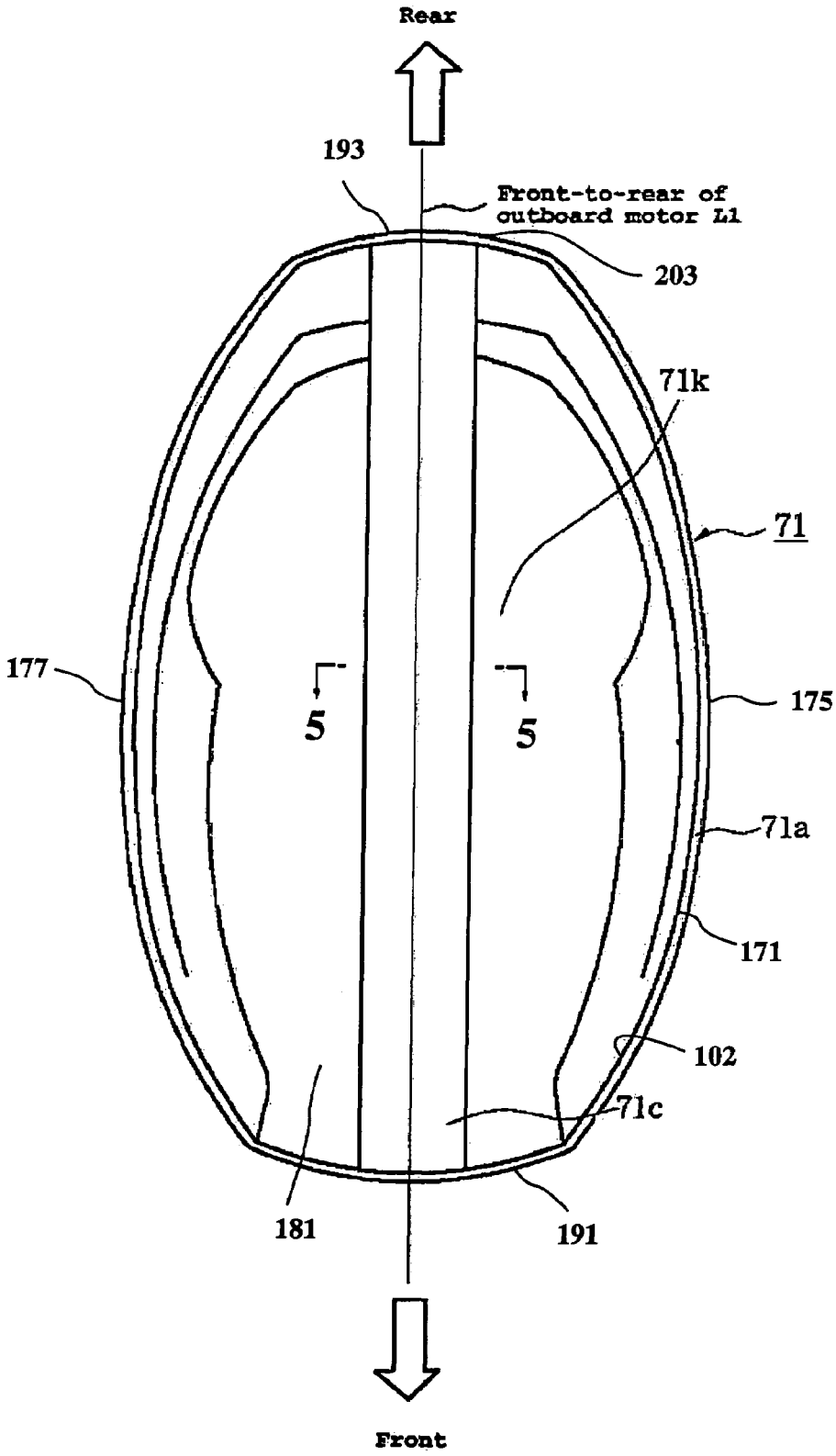
FIG. 3 is a bottom elevational view of the top cowl of FIG. 2.
Figure 4:
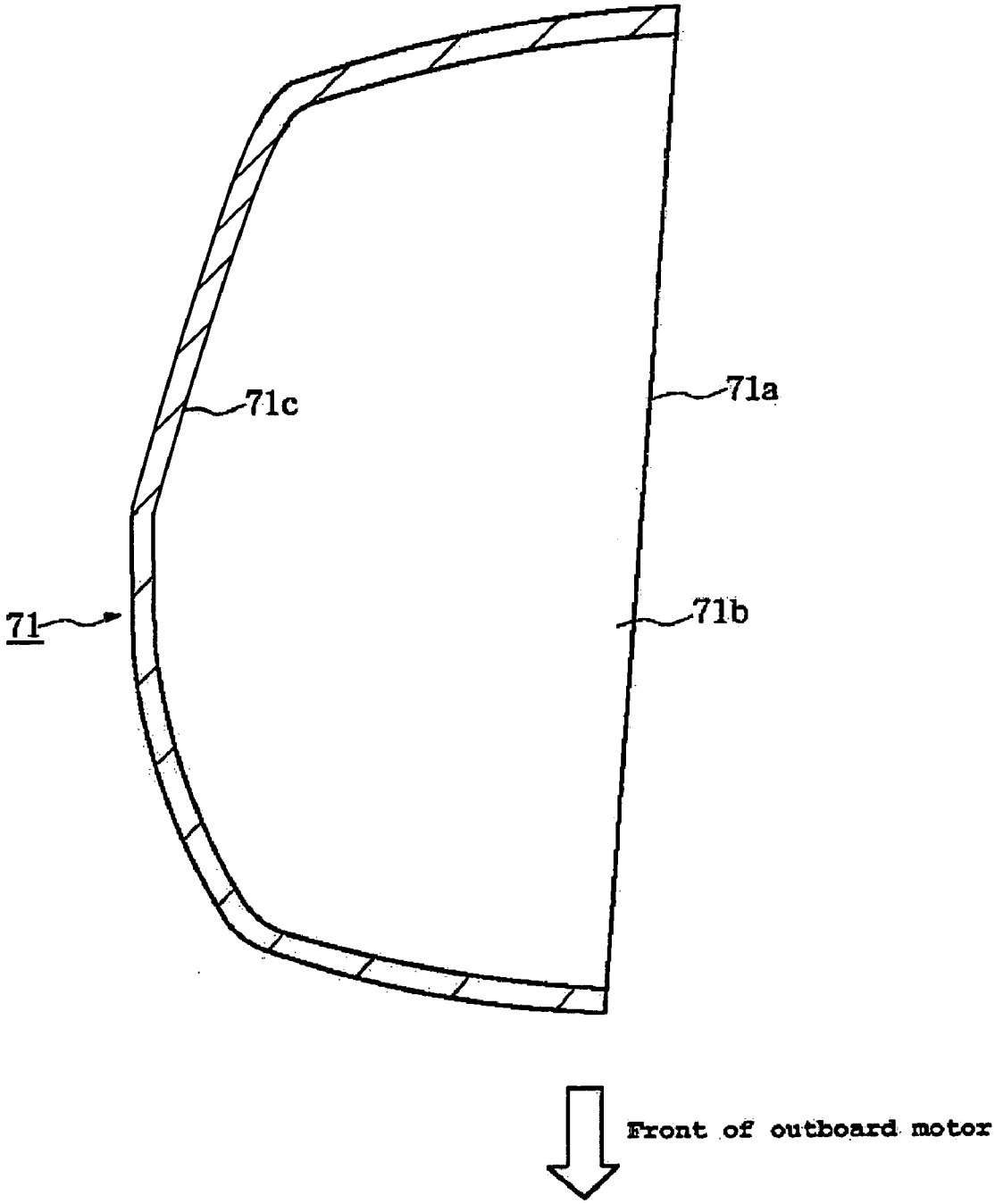
FIG. 4 is a longitudinal cross-sectional view of the top cowl.

With reference to FIG. 1, a watercraft has an outboard motor 1 that is configured in accordance with certain features, aspects, and advantages of the present invention. The outboard motor 1 is a typical marine drive, and thus all the embodiments below are described in the context of an outboard motor. The embodiments, however, can be applied to other marine drives, as will become apparent to those of ordinary skill in the art. The arrow FR in the drawing indicates the forward direction in which the watercraft travels. It will be appreciated, however, that the illustrated embodiments can be located or oriented in a variety of desired positions.

The illustrated watercraft of FIG. 1 has a hull 3 that can float in the water. The hull 3 carries the outboard motor 1, which has a propulsion unit 5 and an internal combustion engine 10 (shown in phantom). The engine 10 of the outboard motor 1 powers the propulsion unit 5 which propels the watercraft. The illustrated propulsion unit 5 is a single propeller system; however, other types of propulsion units can be used as well, such as, for example, a dual counter-rotational propeller system, a jet drive, and the like. The outboard motor 1 is supported on the transom 3*a* of the hull 3 by a clamp bracket 2 so as to place at least a portion of the propulsion unit 5 in a submerged position when the watercraft rests in the water.

A swivel bracket is coupled to the clamping bracket 2 for pivotal movement in a vertical direction about an axis defined by a tilt shaft 6. The swivel bracket has upper and lower damper members for supporting the propulsion unit 4. The outboard motor 1 is preferably steerable and/or tiltable by moving the clamps.

With continued reference to FIG. 1, the propulsion unit 4 has a protective housing that surrounds the internal components of the engine 10. The housing can include a protective cowling 7, an upper casing 8, and a lower casing 9. The cowling 7 can enclose and protect the engine 10. The cowling 7 preferably includes a top cowl 70 and a bottom cowl 71. The top cowl 70 can be removed from the bottom cowl 71 so as to expose the engine 10. Various types of attachment means can be used to couple the top cowl 70 to the bottom cowl 71. Snaps, hooks, fasteners, mechanical fasteners, and the like can be used to couple the cowls 70, 71 together.

An exhaust guide 11 can be disposed within the housing. In the illustrated embodiment, the exhaust guide 11 supports the engine 10 and is surrounded by the bottom cowl 71. The upper casing 8 can be mounted to the exhaust guide 11. The illustrated upper casing 8 extends downwardly from the exhaust guide 11.

The engine 10 has a vertically extending crankshaft 12. A driveshaft 13 extends vertically through the upper casing 8. A top end of the driveshaft 13 is coupled to a bottom end of the crankshaft 12. A bottom end of the driveshaft 13 is coupled to a drive mechanism 14. The illustrated drive mechanism 14 is in the form of a forward and reverse switching mechanism housed within the lower casing 9.

A propeller shaft 15 extends generally horizontally from the forward and reverse switching mechanism 14. A rear end of the propeller shaft 15 extends outwardly from the lower casing 9. A single propeller 16 is fixed to the rear end of the propeller shaft 15. Dual counter-rotational propeller systems or other types of propulsion systems can be used to propel the watercraft.

The illustrated outboard motor 1 of FIG. 1 includes the internal combustion engine 10 which is preferably a multi-cylinder, four-cycle engine. Engines having a different number of cylinders, other cylinder arrangements, various cylinder orientations (e.g., upright cylinder banks, V-type, etc.), and operating on various combustion principles (e.g., four stroke, crankcase compression two-stroke, diesel, and rotary) are all practicable for use with the cowlings disclosed herein. The engine can comprise an engine body defining at least one cylinder bore therethrough. A cylinder head assembly is connected to the cylinder bore, and a piston is disposed within the cylinder bore. The cylinder bore, the cylinder head assembly, and the piston cooperate to define a variable combustion chamber.

As seen in FIG. 1, the top cowl 71 has one or more intake apertures for airflow through the top cowling 71. The illustrated top cowl 71 has a pair of intake apertures 90. Air drawn through the air intake apertures 90 is introduced to an engine compartment 93 through an intake duct 92 of a molding 91. This air is used for the combustion process.

With reference to FIGS. 1 through 5, the top cowl 71 defines at least a portion of an engine compartment 106 and an opening 102 that accommodates the engine 10. In the illustrated embodiment, the top cowl 71 has a lower portion 71*a* having a lower opening edge 71*b* that defines the opening 102. In some non-limiting embodiments, the top cowling 71 comprises a light nonferrous metal with high heat dissipation properties, such as aluminum, aluminum alloys, magnesium, and the like. Various types of manufacturing processes (e.g., die-casting) can be used to form the top cowl 71.

The top cowl 71 has an elongate thickened portion 71*c* along its length. In some embodiments, the thickened portion 71*c* is a portion of the top cowl 71 that has an increased thickness relative to other portions of the top cowl 71. In some embodiments, including the illustrated embodiment, the elongate thickened portion 71*c* is a rib that extends inwardly relative to other portions of the top cowl 71. The illustrated thickened portion 71*c* extends from the front to the rear of the top cowl 71. The portion 71*c* preferably extends centrally along a longitudinal axis of the top cowl 71; however, the portion 71*c* can be at other locations. The top cowl 71 has a sidewall 171 and a top 71*k*. The illustrated sidewall 171 extends generally vertically from the bottom cowl 70. In the illustrated embodiment of FIG. 3, the sidewall 171 has a pair of opposing lateral side walls 175, 177, front wall 191, and a rear wall 193. The lateral side walls 175, 177 extend from the front wall 191 to the rear wall 193. The top 71*k* extends generally horizontally between the top of the sidewall 171. The thickened portion 71*c* preferably extends along the front wall 191, the top 71*k*, and the rear wall 193.

The top cowl 71 has an opening edge 71*b*, which mates with the bottom cowl 70. The thickened portion 71*c* preferably is formed to extend from the forward opening edge 201 of the edge 71*b* through a top face of the cowl 71*k* to the rearward opening edge 203. The thickened portion 71*c* extends along a front wall 191 of the sidewall 171, the top 71*k*, and a rear wall 193 of the sidewall 171. The portion 71*c* can act as a reinforcing member that increases the rigidity of the top cowl 71. In other embodiments, two, three, or any number of thickened portions 71*c* can be provided. Advantageously, the thickened portion 71*c* can provide enhanced rigidity with a relatively low overall weight. When a load is applied to the top face 71*k* of the cowl, for example, the thickened portion 71*c* molded in the larger top cavity by the extended portion 83*c*1 (FIG. 6) functions as a load bearing member.

Figure 5A:
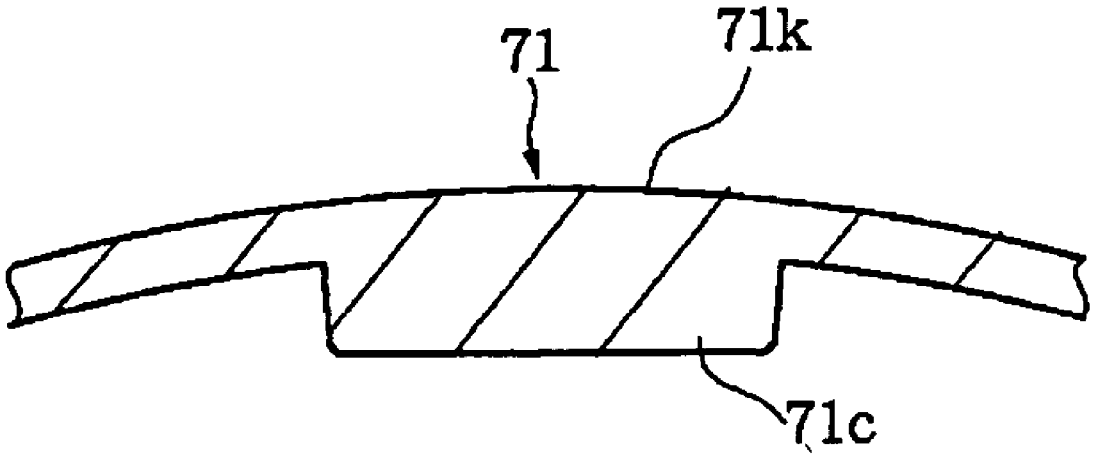
FIG. 5A is a cross-sectional view of the cowling member taken along the line 5-5 of FIG. 3.
Figure 5B:
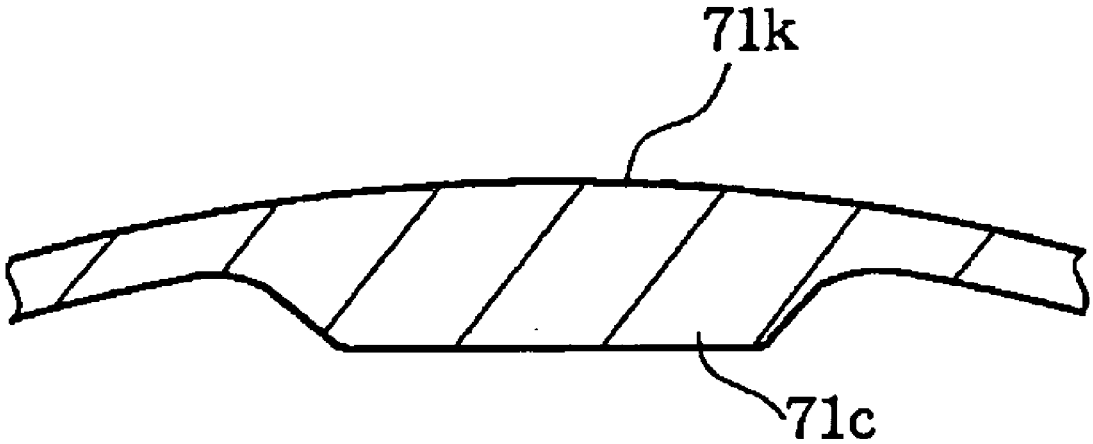
FIG. 5B is a cross-sectional view of the cowling member in accordance with another embodiment, the cross-sectional view is taken along the line 5-5 of FIG. 3.

FIG. 5A illustrates one embodiment of the thick portion 71*c*. In this embodiment, the thickened portion 71*c* has a generally rectangular axial cross-section. The thickened portion 71*c* can also have other cross sections. For example, the thickened portion 71*c* embodiment illustrated in FIG. 5B has side walls that diverge outwardly and upwardly. However, the thickened portion 71*c* can also have other cross-sections, including, but not limited to, semi-circular, polygonal (including rounded polygonal), trapezoidal, or any other suitable axial cross-section. The geometry of the thickened portion 71*c* can be selected to achieve the desired structural properties, such as stiffness, weight, and the like. The moment of inertia of the thickened portion 71*c* can be increased or decreased to decrease or increase, respectively, the deflection for a given load applied to the top of the top cowl 71. In some embodiments, including the illustrated embodiment, the thickened portion 71*c* has an average width that is greater than a distance that the thickened portion extends inwardly from the top cowl 71.

The thickened portion 71*c* preferably extends downwardly from the inside wall of the top cowl 71. The upper wall 71*k* protects the thickened portion 71*c* of the top cowl 71. As such, the thickened portion 71*c* is not exposed to the external environment. In such an embodiment, the thickened portion 71*c* maintains enhanced rigidity without being visible.

Figure 6:
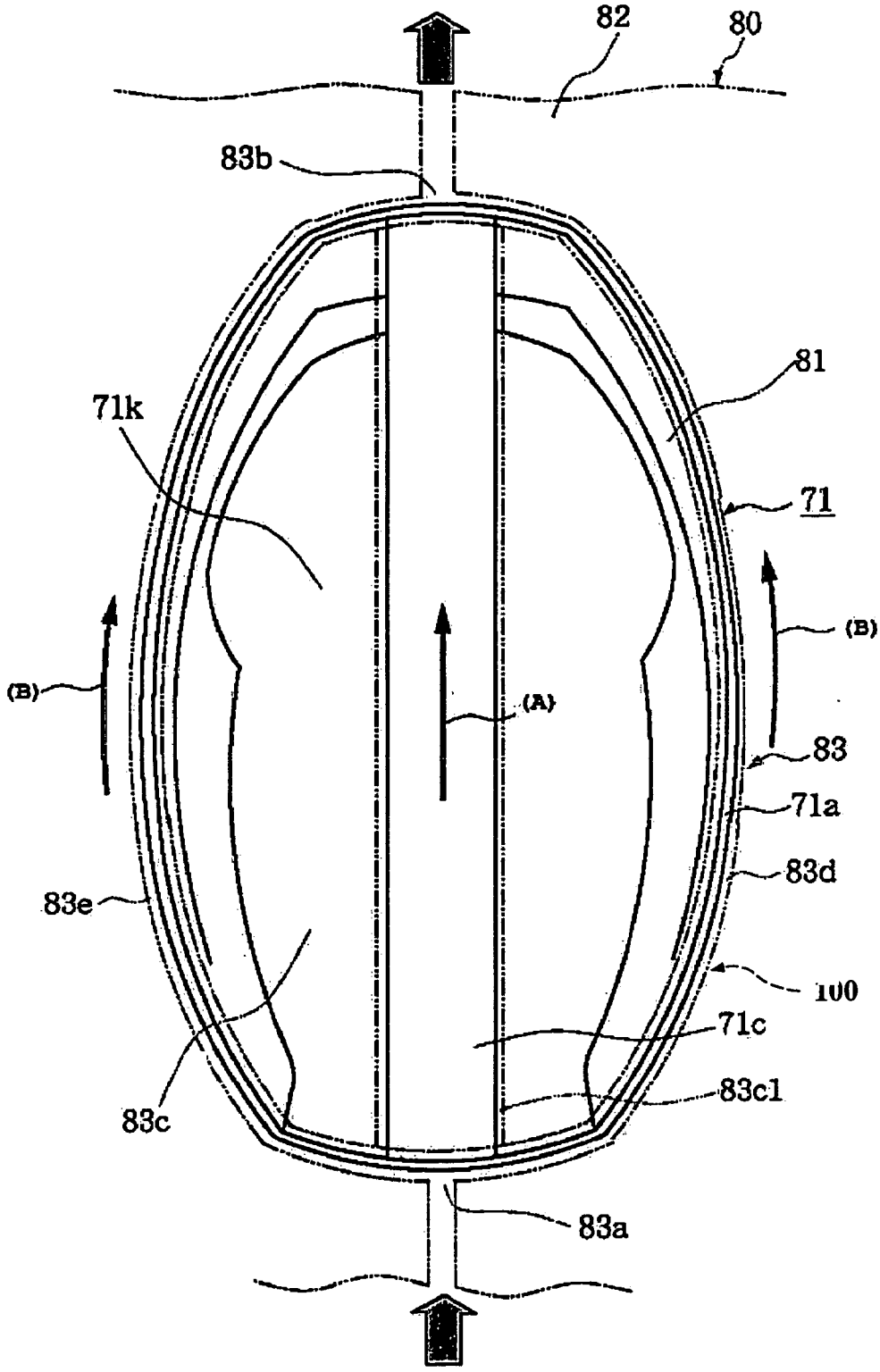
FIG. 6 illustrates molten material flowing during the molding process for forming a top cowl.
Figure 7:
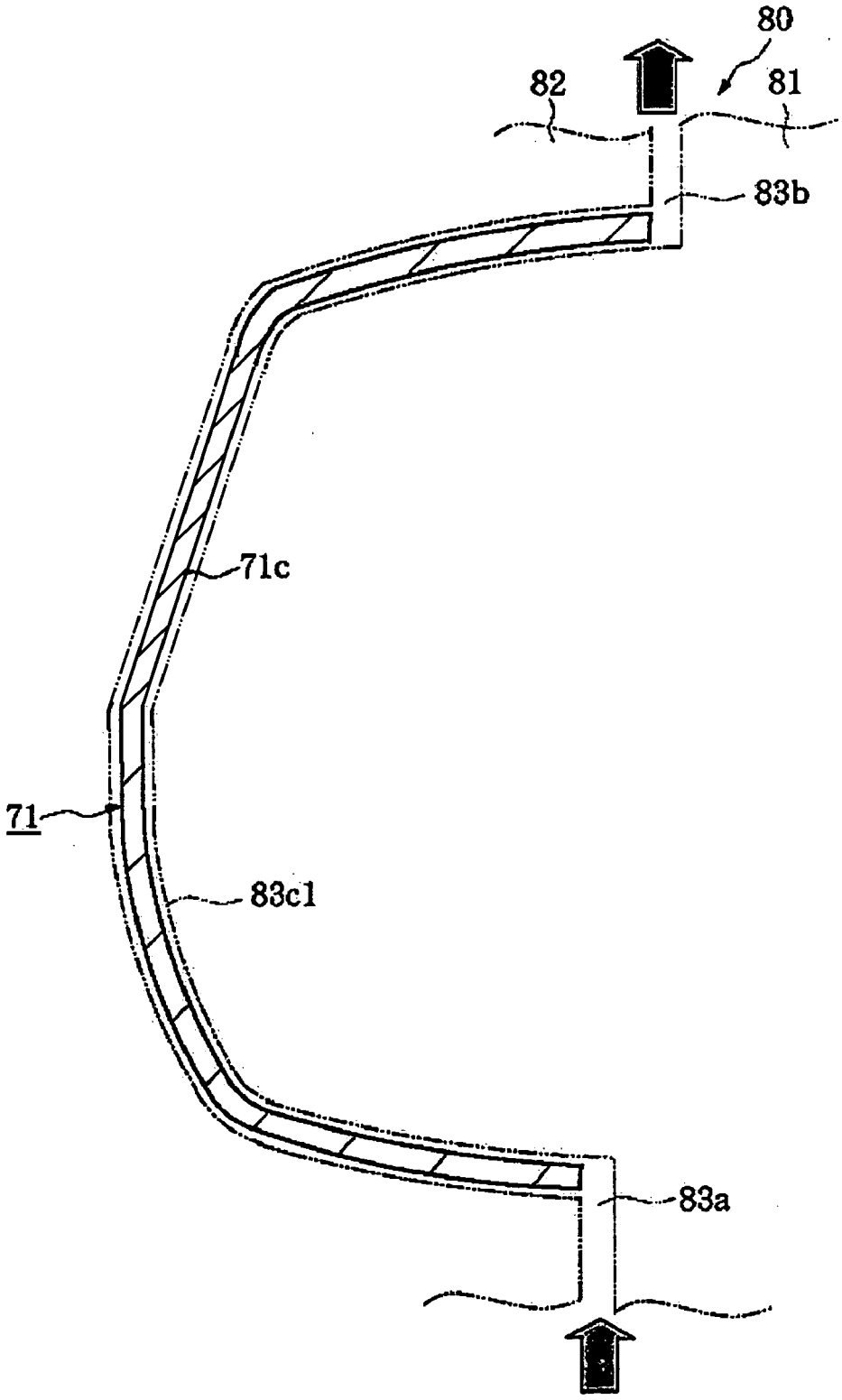
FIG. 7 illustrates molten metal flow across a top cavity for a cowl during the molding process.

FIGS. 6 and 7 illustrate an embodiment of a die-casting process for making the top cowl 71. FIG. 6 illustrates a portion of molten metal flow across side cavities during the molding process of the top cowl. For illustrative purposes, the molten metal is shown spaced from the surfaces of the mold.

The illustrated mold 80 has first and second mold sections 81, 82. The first and second mold sections 81, 82 form a mold cavity 110 (shown in phantom) generally corresponding to the shape of the top cowl 71. A molten material can be delivered into the mold 80 to form the top cowl 71. Various types of materials can be used in the illustrated mold. In some embodiments, molten metal 83 is delivered into the mold 80.

An entrance sprue 83*a* and exit sprue 83*b* are at opposing ends of the mold cavity 110. The entrance sprue 83*a* preferably is positioned at the front of the top cowl 71. The exit sprue 83*b* preferably is at the rear of the top cowl 71. As seen in FIG. 7, the sprues 83*a*, 83*b* preferably are positioned proximate the lower edge 71*b* of the top cowl 71. In the illustrated embodiment, the entrance sprue 83*a* is positioned on the bottom side of the mold 80 while the exit sprue 83*b* is positioned on the topside thereof. It is to be understood that the entrance sprue 83*a* and the exit sprue 83*b* can be at other locations.

Molten material can flow along various flow paths defined by the mold 80. The illustrated mold 80 has a top cavity 83*c* that forms the top 71*k* of the top cowl 71. Molten metal from the entrance sprue 83*a* flows to the exit sprue 83*b*, as indicated by the arrow A, through the top cavity 83*c*.

The mold 80 also has opposing side cavities 83*d*, 83*e*. Molten material flows through the side cavities 83*d*, 83*e*, as indicated by the arrows B. In the illustrated embodiment, molten material from the entrance sprue 83*a* is divided into separate flows that flow into the side cavities 83*d*, 83*e*. The molten material proceeds along the side cavities 83*d*, 83*e* and is ultimately discharged out of the exit sprue 83*b*.

To form the top cowl 71, molten metal is delivered through the entrance sprue 83*a* into the mold cavity 83. The molten material can flow into each of the cavities 83*c*, 83*d*, 83*e*. In some embodiments, the molten material can fill the cavities 83*c*, 83*d*, 83*e* simultaneously. During the filling process, for example, the molten material can flow evenly through the entire mold 80, preferably filling the entire mold 80. In some embodiments, the molten material can flow through the cavities 83*c*, 83*d*, 83*e* at substantially the same average velocity, if desired.

When the top cavity 83*c* has an extended portion 83*c*1 that extends in the fore to aft direction of the outboard motor, the molten metal flow enters the entrance sprue 83*a* and is then generally divided into two flows. The extended portion 83*c*1 defines a flow path having a length that is greater than the lengths of other flow paths through the side cavities 83*d*, 83*e*. The extended portion 83*c*1 is preferably configured to form the thickened portion 71*c* of the top cowl 71.

When the flow from the entrance sprue 83*a* is divided into sub flows, one of the flows can proceed towards the top cavity 83*c* and the other flows can proceed towards the side cavities 83*d*, 83*e*. As seen in FIGS. 6 and 7, the flow distance through the top cavity 83*c* (FIG. 7) can be longer than the flow distance through the side cavities 83*d*, 83*e*.

In some embodiments, the flow rate of the flow passing through the top cavity 83*c* can be greater than the flow rate of the side flow passing through the side cavities 83*d*, 83*e*. The flow resistances of the mold cavity 80 can be selected to achieve a somewhat uniform flow front across the mold. For example, the injected material can flow at a higher flow rate through the extended portion 83*c*1 as compared to the flow rates through the side cavities 83*d*, 83*e* because of the low flow resistance through the extended portion 83*c*1. The size of the flow space defined by the extended portion 83*c*1 preferably is greater than either of the flow spaces defined by the side cavities 83*d*, 83*e*. For example, in the illustrated embodiment, the cross-sectional area of the flow space defined by the extended portion 83*c*1 is greater than the cross-sectional area of the flow spaces defined by either of the side cavities 83*d*, 83*c*. In such embodiments, the extended portion 83*c*1 has a flow resistance that is less than the flow resistance of the cavities 83*d*, 83*e*, such that the injected flows reach the exit sprue 83*b* at the same time. The fore-to-aft progress of the molten material through the cavities 83*c*, 83*d*, 83*e* preferably is generally the same. Accordingly, the flow velocities in the fore to aft direction of the molten material in the cavities 83*c*, 83*d*, 83*e* can be generally the same.

If the molten material flows evenly across the mold, the quality of the molded top cowling 71 can be improved. The uniform flow front can minimize air that gets trapped in the mold 80. This is because the flow across the top cavity and the side flows reduce or substantially eliminate any air bubble within the molded article thereby improving the quality of the molded article.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An outboard motor having a cowling comprising a bottom cowl and a top cowl configured to couple to the bottom cowl, the top cowl comprising a top cowl body that surrounds at least a portion of an engine of the outboard motor, the top cowl configured to couple with the bottom cowl, and the top cowl comprising an elongate thickened portion that extends longitudinally along the top cowl body in a fore to aft direction between a front end and a rear end of the top cowl body.

2. The outboard motor of claim 1, wherein the elongate thickened portion is an elongate band that extends inwardly from an inside surface of the top cowl, and the inside surface of the top cowl defines at least a portion of a chamber accommodating the engine.

3. The outboard motor of claim 1, wherein the elongate thickened portion is positioned generally midway between lateral side walls of the top cowl body.

4. The outboard motor of claim 3, wherein the elongate thickened portion extends inwardly from an inner surface of the top cowl towards the engine.

5. The outboard motor of claim 1, wherein the elongate thickened portion is a generally continuous elongate thickened portion that extends centrally along the top cowl.

6. The outboard motor of claim 5, wherein the top cowl further comprises an edge that surrounds the engine and mates with the bottom cowl, and a front end of the elongate thickened portion is adjacent the edge in a front portion of the top cowl and a rear end of the elongate thickened portion is adjacent the edge in a rear portion of the top cowl.

7. The outboard motor of claim 1, wherein the top cowl further comprises an opening edge configured to mate with the bottom cowl, and the elongate thickened portion extends along the top cowl from a forward end of the opening edge to a rearward end of the opening edge.

8. The outboard motor of claim 2, wherein the top cowl comprises a nonferrous metal.

9. The outboard motor of claim 1, wherein the elongate thickened portion has an average width that is greater than a distance that the elongate thickened portion extends inwardly from the top cowl.

10. The outboard motor of claim 1, wherein the top cowl further comprises a plurality of elongate thickened portions.

11. The outboard motor of claim 1, wherein the elongate thickened portion has a substantially rectangular axial cross-section.

12. A mold for forming a top cowl of nonferrous metal for an outboard motor, the mold comprising first and second mold portions that define a mold cavity shaped to form a top cowl having a top portion and side wall portions that depend from the top portion and define a bottom edge of the top cowl, an entrance sprue disposed at a front end of the mold cavity, an exit sprue disposed at a rear end of the mold cavity, a top cavity of the mold cavity configured to accommodate flow of molten metal from the entrance sprue to the exit sprue so as to form the top portion of the top cowl, side cavities of the mold cavity, the side cavities configured to accommodate flow of molten metal from the entrance sprue to the exit sprue so as to form the side wall portions of the top cowl, and a bottom edge of the mold cavity corresponding to the bottom edge of the top cowl, wherein the entrance and exit sprues are positioned at or adjacent the bottom edge of the mold cavity, and the top cavity and side cavities are configured so that molten metal flows faster through the top cavity than through the side cavities.

13. The mold of claim 12, wherein the entrance sprue and exit sprue are positioned in the aft to fore direction of the top cowl.

14. The mold of claim 12, wherein the side cavities and top cavity are shaped such that the nonferrous metal that exits the entrance sprue and is divided into a top flow that flows through the top cavity and side flows that flow through the side cavities, and the top flow and side flows reach the exit sprue at generally the same time.

15. The mold of claim 12, wherein a length of a flowpath from the entrance sprue through the top cavity is greater than a flowpath from the entrance sprue through one of the side cavities.

16. The mold of claim 12, wherein the top cavity is configured to form a reinforcement thickened portion that extends longitudinally along the top cavity.

17. The mold of claim 12, wherein molten metal that flows through the top cavity travels towards the exit sprue at substantially the same velocity in the fore to aft direction as the molten metal that flows through the side cavities.

18. The mold of claim 12, wherein the top cavity has a thickened portion for less flow resistance than the flow resistance of the side cavities.

19. The mold of claim 12, wherein the mold is configured such that material injected into the mold cavity flows upwardly from the entrance sprue to the exit sprue.

20. The outboard motor of claim 1, wherein the top cowl body is unitarily formed.

21. An outboard motor of claim 20, wherein the elongate thickened portion extends continuously from the front end to the rear end of the top cowl body.

22. An outboard motor having a cowling comprising a bottom cowl and a top cowl configured to couple to the bottom cowl, the top cowl comprising a top cowl body that surrounds at least a portion of an engine of the outboard motor, the top cowl configured to couple with the bottom cowl, and the top cowl comprising an elongate thickened portion that extends along the top cowl body in a fore to aft direction between a front end and a rear end of the top cowl body, wherein the top cowl further comprises an opening edge configured to mate with the bottom cowl, and the elongate thickened portion extends along the top cowl from a forward end of the opening edge to a rearward end of the opening edge.

* * * * *